US006435978B1

(12) United States Patent
Galloway et al.

(10) Patent No.: US 6,435,978 B1
(45) Date of Patent: Aug. 20, 2002

(54) INTERNAL OFF-SET HOSEL FOR A GOLF CLUB HEAD

(75) Inventors: J. Andrew Galloway, Escondido; Richard C. Helmstetter, Rancho Santa Fe; Homer E. Aguinaldo, San Diego; Alan Hocknell, Encinitas, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/683,402

(22) Filed: Dec. 21, 2001

Related U.S. Application Data

(60) Division of application No. 09/548,968, filed on Apr. 13, 2000, now Pat. No. 6,371,868, which is a continuation-in-part of application No. 09/431,982, filed on Nov. 1, 1999, now Pat. No. 6,354,962.

(51) Int. Cl.[7] ..... A63B 53/02; B65D 5/00; B21D 39/03

(52) U.S. Cl. ..... 473/305; 473/409; 473/345; 473/311; 29/428; 228/110.1

(58) Field of Search ..... 473/342, 345, 473/346, 349, 332, 290, 291, 324, 329, 305–315, 409; 29/428; 228/110.1

(56) References Cited

U.S. PATENT DOCUMENTS

| | | | | |
|---|---|---|---|---|
| 4,687,205 A | | 8/1987 | Tominaga et al. | |
| 5,172,913 A | | 12/1992 | Bouquet | |
| 5,232,224 A | * | 8/1993 | Zeider | 273/167 H |
| 5,261,663 A | | 11/1993 | Anderson | |
| 5,261,664 A | | 11/1993 | Anderson | |
| 5,272,802 A | | 12/1993 | Stites, III | |
| 5,344,140 A | | 9/1994 | Anderson | |
| 5,346,217 A | | 9/1994 | Tsuchiya et al. | |
| 5,405,136 A | | 4/1995 | Hardman | |
| 5,429,357 A | | 7/1995 | Kobayashi | |
| 5,460,371 A | | 10/1995 | Takeda | |
| 5,464,216 A | | 11/1995 | Hoshi et al. | |
| 5,474,296 A | | 12/1995 | Schmidt et al. | |
| 5,485,998 A | | 1/1996 | Kobayashi | |
| 5,501,459 A | | 3/1996 | Endo | |
| 5,527,034 A | | 6/1996 | Ashcraft et al. | |
| 5,556,097 A | | 9/1996 | Endo et al. | |
| 5,776,011 A | | 7/1998 | Su et al. | |
| 5,788,584 A | | 8/1998 | Parente et al. | |
| 5,797,807 A | | 8/1998 | Moore | |
| 5,911,638 A | * | 6/1999 | Parente et al. | 473/338 |
| 6,001,027 A | | 12/1999 | Hansberger | |
| 6,165,081 A | | 12/2000 | Chou | |
| 6,371,868 B1 | * | 4/2002 | Galloway et al. | 473/324 |

FOREIGN PATENT DOCUMENTS

| | | |
|---|---|---|
| JP | 05116557 | 4/1993 |
| JP | 07216213 | 8/1995 |
| JP | 09235312 | 7/1997 |
| JP | 10028281 | 2/1998 |

* cited by examiner

*Primary Examiner*—Paul T. Sewell
*Assistant Examiner*—Sneh Varma
(74) *Attorney, Agent, or Firm*—Michael A. Catania

(57) ABSTRACT

A golf club having an interior hosel that is disposed inward from a striking plate to allow for compliance of the striking plate during impact with a golf ball. The present invention also includes a method for producing the golf club in which the interior hosel is attached to a lateral extension of a face member. The lateral extension is connected to the striking plate. The striking plate is preferably composed of a forged titanium material.

10 Claims, 11 Drawing Sheets

INTERNAL OFF-SET HOSEL FOR A GOLF CLUB HEAD

Cross Reference to Related Applications

The present application is a divisional application of co-pending U.S. patent application Ser. No. 09/548,968, filed on Apr. 13, 2000 ,now U.S. Pat. No. 6,371,868, B1 which is a continuation-in-part application of co-pending U.S. patent application Ser. No. 09/431,982, filed on Nov. 1, 1999, now U.S. Pat. No. 6,354,962 B1 or A Golf Club Head With A Face Composed Of A Forged Material.

FEDERAL RESEARCH STATEMENT

BACKGROUND OF INVENTION

1. Field of the Invention

The present invention relates to a golf club head with an internal hosel and a method of manufacturing the same. More specifically, the present invention relates to a golf club head with an internal hosel moved inward off of the striking plate and a method of manufacturing the same.

Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10-100 times larger than the damping properties of a metallic club face. Thus, during impact most of the energy is lost as a result of the high stresses and deformations of the golf ball (0.001 to 0.20 inches), as opposed to the small deformations of the metallic club face (0.025 to 0.050 inches). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches.

Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact.

A fluid is disposed between at least two of the plates to act as a viscous coupler.

Yet another example is Jepson et al, U.S. Pat. No. 3,937,474, for a golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert of Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Finally, Aizawa, U.S. Pat. No. 5,346,216 for a Golf Club Head, discloses a face plate having a curved ball hitting surface.

The Rules of Golf, established and interpreted by the United States Golf Association (USGA) and The Royal and;Ancient Golf Club of Saint Andrews, set forth certain requirements for a golf club head. The requirements for a golf club head are found in Rule 4 and Appendix II. A complete description of the Rules of Golf is available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e that measures club face COR. This USGA test procedure, as well as procedures like it, may be used to measure club face COR.

Although the prior art has disclosed many variations of face plates, the prior art has failed to provide a face plate with a high coefficient of restitution composed of a thin material, and to construct a golf club that allows for maximum performance from the face plate.

SUMMARY OF INVENTION

The present invention provides a golf club head with an interior hosel that is disposed inward from a striking plate allowing for greater compliance of the striking plate with a golf ball during impact. A more compliant striking plate provides for lower energy loss and a higher coefficient of restitution.

One aspect of the present invention is a method for producing a golf club head with an internal hosel. The method includes providing a face member that has a striking plate with an interior surface and a face extension extending laterally inward from the interior surface of the striking plate. The face extension has an upper portion, a lower portion and a heel wall.

The method also includes drilling a hole through the upper portion of the face extension in proximity to the heel wall. The method also includes placing a cylinder in alignment with the hole in the upper portion. The method further includes attaching the cylinder to the upper portion and the lower portion of the face extension with the cylinder disposed inward from the striking plate.

Another aspect of the present invention is a golf club head including a face member, an interior hosel, a crown and a sole. The face member includes a striking plate for striking a golf ball. The striking plate has an exterior surface, an interior surface, and a perimeter. The striking plate extends from a heel section of the golf club head to a toe section of the golf club head. The face member also includes a face extension extending laterally inward along the entire perimeter of the striking plate. The face extension has an upper portion, a lower portion opposite the upper portion, a heel wall in the heel section of the golf club head and substantially perpendicular to the face plate, and a toe wall in the toe section of the golf club head. The interior hosel receives a shaft and is attached to the upper portion of the face extension and the lower portion of the face extension. The entire interior hosel is disposed inward from the striking plate thereby allowing for compliance of the striking plate during impact with a golf ball. The crown member is secured to the upper portion of the face extension at a predetermined distance from the striking plate. The sole member is secured to the lower portion of the face extension at a predetermined distance from the striking plate.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
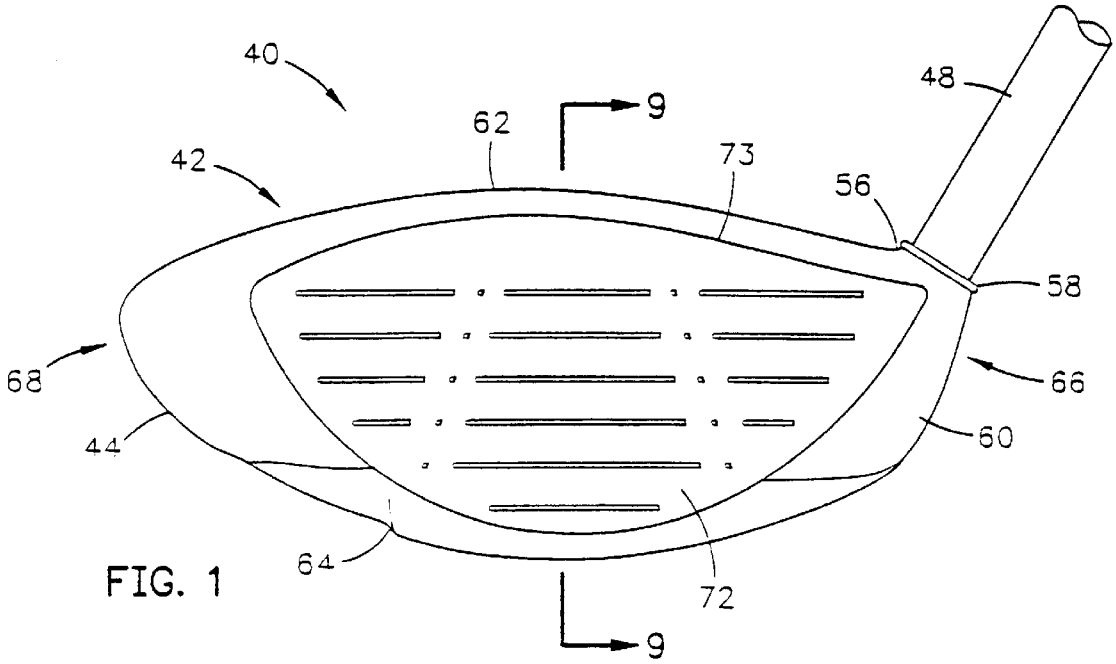
FIG. 1 is a front view of the golf club of the present invention.

The present invention is directed at a golf club head with an interior hosel that is off set from a striking plate allowing for greater compliance of the striking plate during impact with a golf ball. The compliant striking plate allows for a high coefficient of restitution thereby allowing for greater distance of a golf ball hit with the golf club head of the present invention. The coefficient of restitution (also referred to herein as COR) is determined by the following equation:

$$e=v_2v_1u_1u_2$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of would be 1.0. The present invention provides a club head having a striking plate or face with a coefficient of restitution approaching 0.93, as measured under conventional test conditions.

As shown in FIGS. 1–5, a golf club is generally designated 40. Such a golf club is described in greater detail in co-pending U.S. patent application No. 09/431,982, filed on Nov. 1,1999, for A Golf Club Head With A Face Composed Of A Forged Material, which is hereby incorporated by reference in its entirety. The golf club 40 has a golf club head 42 with a body 44 and a hollow interior 46, not shown. Engaging the club head 42 is a shaft 48 that has a grip 50, not shown, at a butt end 52 and is inserted into a hosel 54 at a tip end 56:. An 0-ring 58 may encircle the shaft 48 at an aperture 59 to the hosel 54.

The body 44 of the club head 42 is generally composed of four sections, the hosel 54, a face member 60, a crown 62 and a sole 64. The club head 42 may also be partitioned into a heel section 66 nearest the shaft 48, a toe section 68 opposite the heel section 66, and a rear section 70 opposite the face member 60.

The face member 60 is generally composed of a single piece of metal, and is preferably composed of a forged metal material. More preferably, the forged metal material is a forged titanium material. However, those skilled in the relevant art will recognize that the face member may be composed of other materials such as steels, vitreous metals, ceramics, composites, carbon, carbon fibers and other fibrous materials without departing from the scope and spirit of the present invention. The face member 60 generally includes a striking plate (also referred to herein as a face plate) 72 and a face extension 74 extending laterally inward from the perimeter of the striking plate 72. The striking plate 72 has a plurality of scorelines 75 thereon. A more detailed explanation of the scorelines 75 is set forth in co-pending U.S. patent application No. 09/431,521, filed on Nov. 1, 1999, entitled Contoured Scorelines For The Face Of A Golf Club, and incorporated by reference in its entirety. The face extension 74 generally includes an upper lateral extension 76, a lower lateral extension 78, a heel wall 80 and a toe wall 82. As shown, the face extension 74 is generally non-planar.

Figure 2:
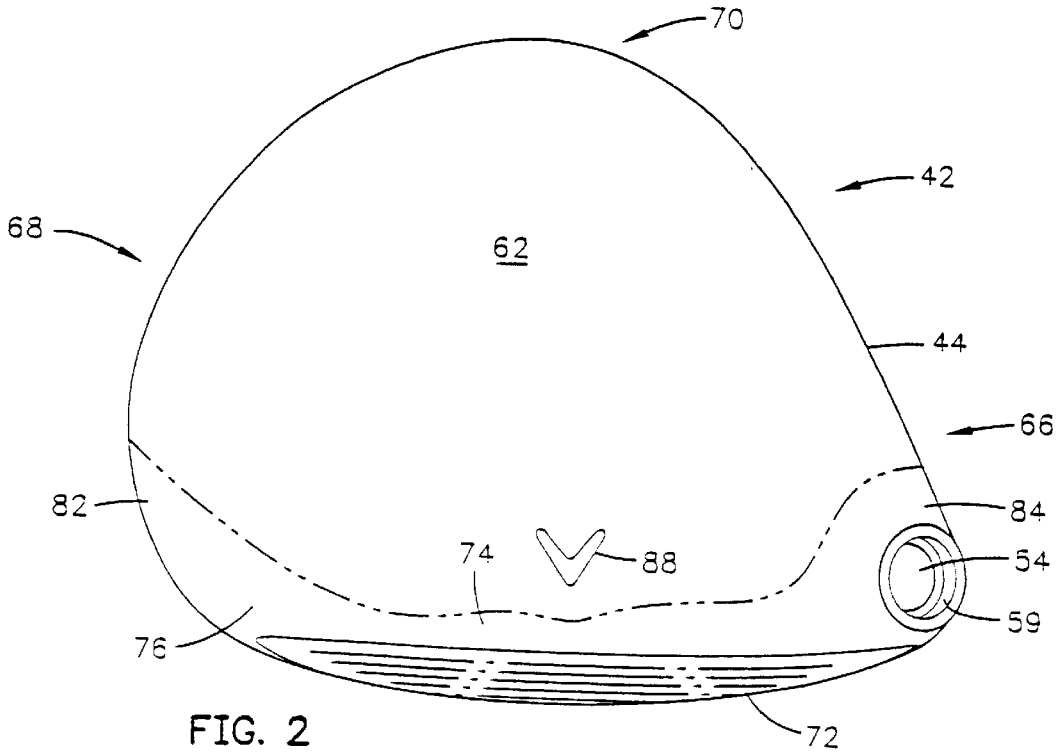
FIG. 2 is a top plan view of golf club head of FIG. 1.
Figure 2A:
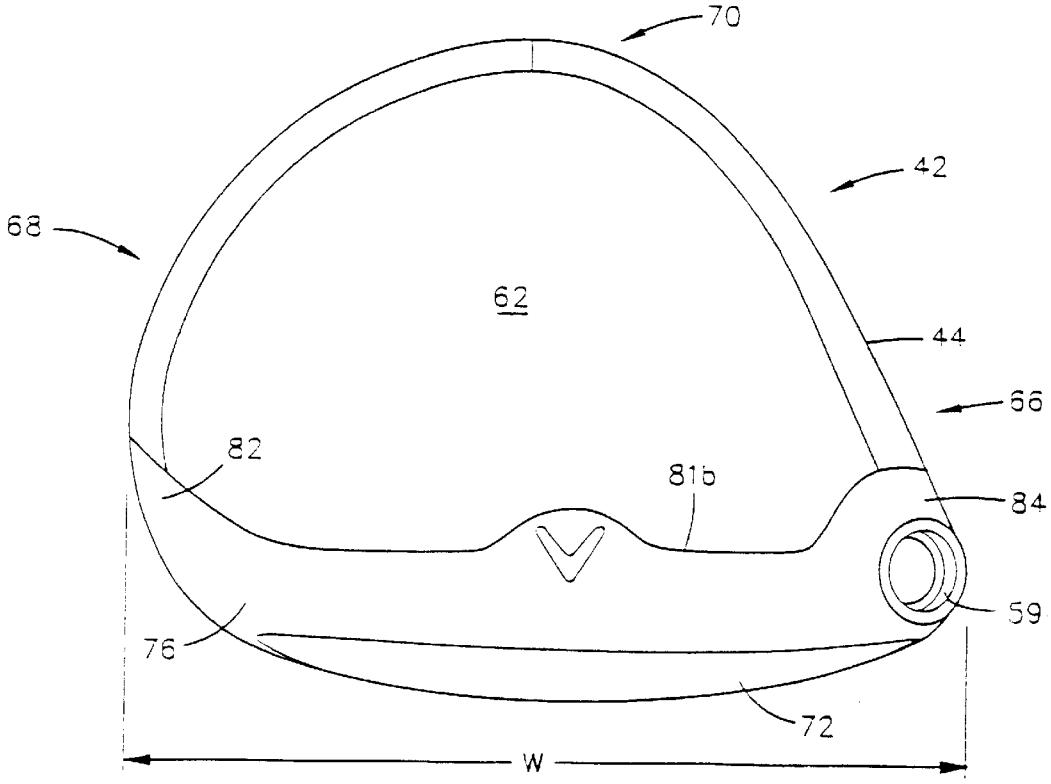
FIG. 2A is a top plan view of an alternative embodiment of the golf club of the present invention.
Figure 3:
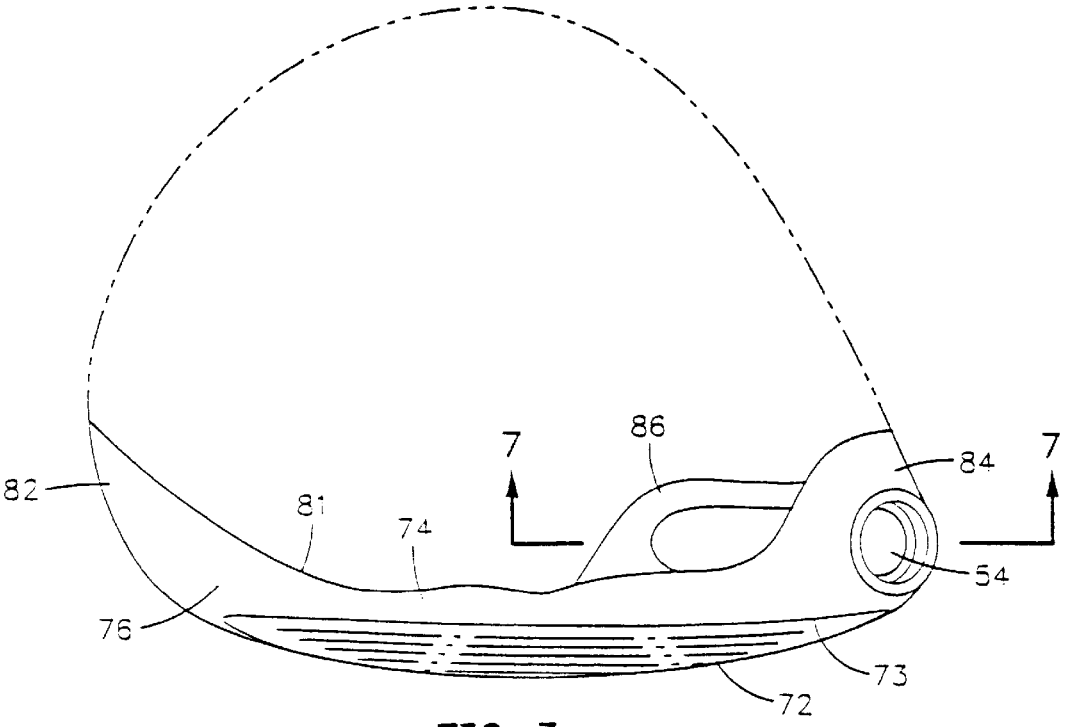
FIG. 3 is a top plan isolated view of the face member of the golf club head of the present invention with the crown in phantom lines.
Figure 4:
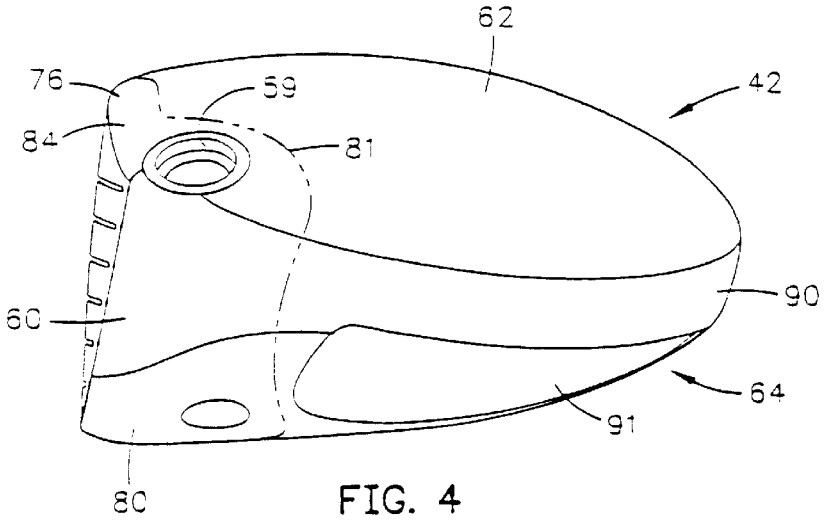
FIG. 4 is a side plan view of the golf club head of the present invention.
Figure 4A:
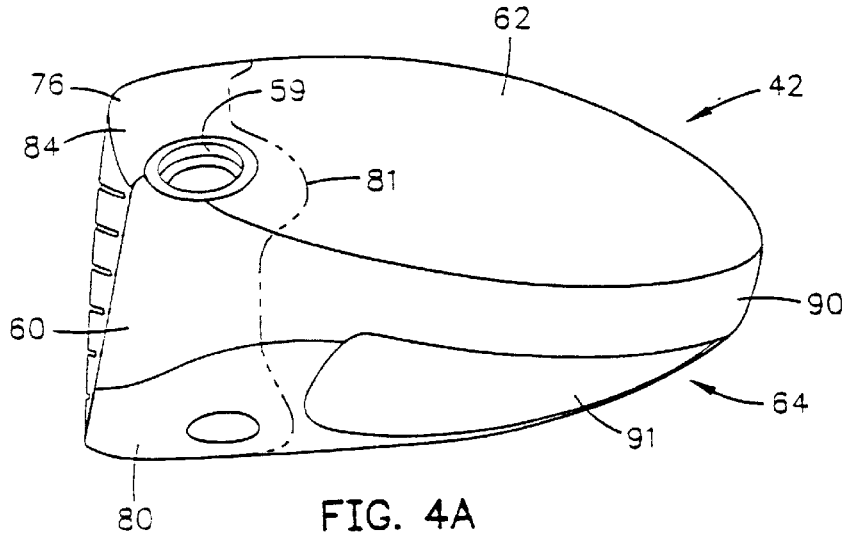
FIG. 4A is a side plan view of an alternative embodiment of the golf club head of the present invention.
Figure 5:
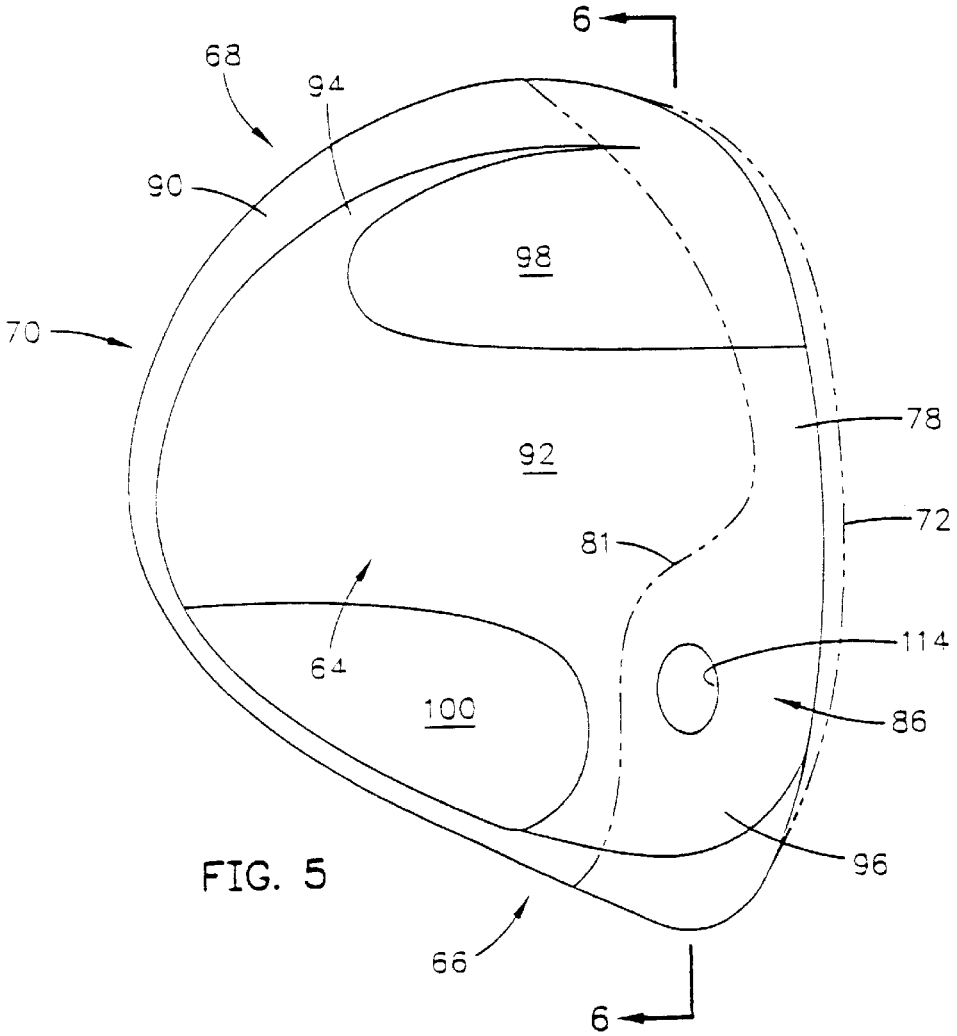
FIG. 5 is a bottom view of the golf club head of the present invention.

The upper lateral extension 76 extends inward, toward the hollow interior 46, a predetermined distance to engage the crown 62. In a preferred embodiment, the predetermined distance ranges from 0.2 inch to 1.0 inch, as measured from the perimeter 73 of the face plate 72 to the edge of the upper lateral extension 76. Unlike the prior art which has the crown engage the face plate perpendicularly, the present invention has the face member 60 engage the crown 62 along a substantially horizontal plane. Such engagement enhances the flexibility of the striking plate 72 allowing for a greater coefficient of restitution. The crown 62 and the upper lateral extension 76 are secured to each other through welding or the like along the engagement line 81. As illustrated in FIG. 2A, in an alternative embodiment, the upper lateral extension 76 engages the crown 62 at a greater distance inward thereby resulting in a weld that is more rearward from the stresses of the striking plate 72 than that of the embodiment of FIG. 2.

The uniqueness of the present invention is further demonstrated by a hosel section 84 of the upper lateral extension 76 that encompasses the aperture 59 to the interior hosel 54. The hosel section 84 has a width $w_1$ that is greater than a width $w_2$ of the entirety of the upper lateral extension 76. The hosel section 84 gradually transitions into the heel wall 80. The heel wall 80 is substantially perpendicular to the striking plate 72, and the heel wall 80 covers the interior hosel 54 before engaging a ribbon 90 and a bottom section 91 of the sole 64. The heel wall 80 is secured to the sole 64, both the ribbon 90 and the bottom section 91, through welding or the like.

At the other end of the face member 60 is the toe wall 82 which arcs from the striking plate 72 in a convex manner. The toe wall 82 is secured to the sole 64, both the ribbon 90 and the bottom section 91, through welding or the like.

The lower lateral extension 78 extends inward, toward the hollow interior 46, a predetermined distance to engage the sole 64. In a preferred embodiment, the predetermined distance ranges from 0.2 inches to 1.0 inches, as measured from the perimeter 73 of the striking plate 72 to the end of the lower lateral extension 78. Unlike the prior art which has the sole plate engage the face plate perpendicularly, the present invention has the face member 60 engage the sole 64 along a substantially horizontal plane. This engagement moves the weld heat affected zone rearward from a strength critical crown/face plate radius region. Such engagement enhances the flexibility of the striking plate 72 allowing for a greater coefficient of restitution. The sole 64 and the lower lateral extension 78 are secured to each other through welding or the like, along the engagement line 81. The uniqueness of the present invention is further demonstrated by a bore section 86 of the lower lateral extension 78 that encompasses a bore 114 in the sole 64 leading to the interior hosel 54. The bore section 86 has a width $w_3$ that is greater than a width $w_4$ of the entirety of the lower lateral extension 78. The bore section 86 gradually transitions into the heel wall 80.

The crown 62 is generally convex toward the sole 64, and engages the ribbon 90 of sole 64 outside of the engagement with the face member 60. The crown 62 may have a chevron decal 88, or some other form of indicia scribed therein that may assist in alignment of the club head 42 with a golf ball. The crown 62 preferably has a thickness in the range of 0.025 to 0.060 inch, and more preferably in the range of 0.035 to 0.043 inch, and most preferably has a thickness of 0.039 inch. The crown 62 is preferably composed of a hot formed or coined material such as a sheet titanium. However, those skilled in the pertinent art will recognize that other materials or forming processes may be utilized for the crown 62 without departing from the scope and spirit of the present invention.

The sole 64 is generally composed of the bottom section 91 and the ribbon 90 that is substantially perpendicular to the bottom section 91. The bottom section 91 is generally convex toward the crown 62. The bottom section has a medial ridge 92 with a first lateral extension 94 toward the toe section 68 and a second lateral extension 96 toward the heel section 66. The medial ridge 92 and the first lateral extension 94 define a first convex depression 98, and the medial ridge 92 and the second lateral extension 96 define a second convex depression 100. A more detailed explanation of the sole 64 is set forth in U.S. Pat. No. 6.007,433, filed on Apr. 2, 1998, for a Sole Configuration For Golf Club Head, which is hereby incorporated by reference in its entirety. The sole 64 preferably has a thickness in the range of 0.025 to 0.060 inch, and more preferably 0.047 to 0.055 inch, and most preferably has a thickness of 0.051 inch. The sole 64 is preferably composed of a hot formed or coined metal material such as a sheet titanium material. However, those skilled in the pertinent art will recognize that other materials and forming processes may be utilized for the sole 64 without departing from the scope and spirit of the present invention.

Figure 6:
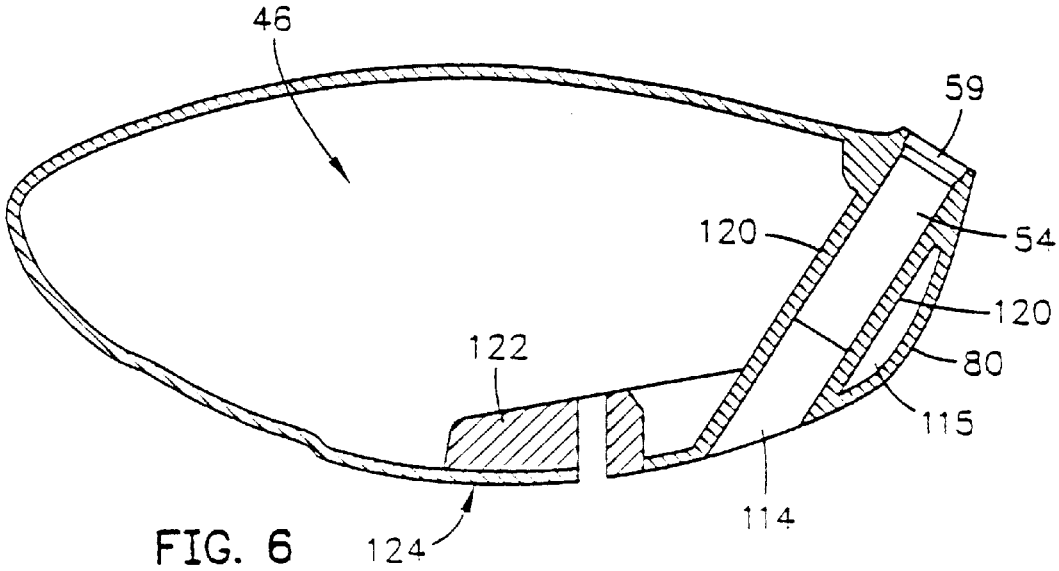
FIG. 6 is a cross-sectional view along line 6—6 of FIG. 5.
Figure 8:
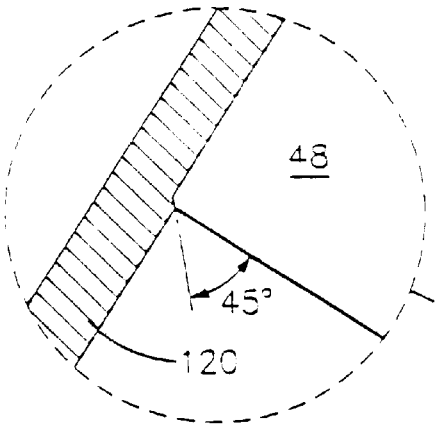
FIG. 8 is an enlarged view of circle 8 of FIG. 7.
Figure 7:
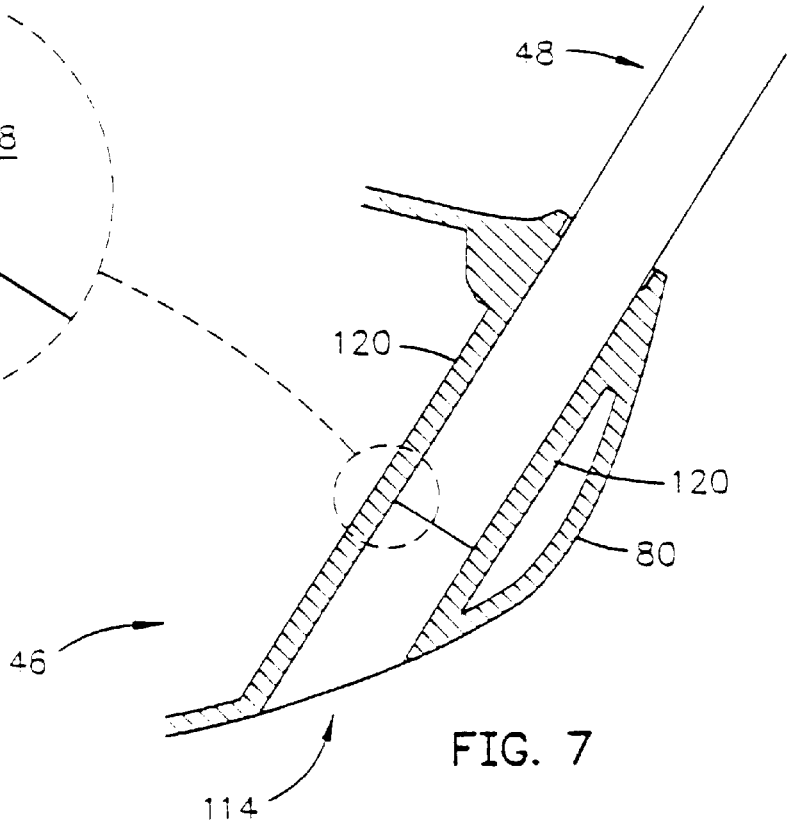
FIG. 7 is a cross-sectional view along line 7—7 of FIG. 3 illustrating the hosel of the golf club head present invention.

FIGS. 6–8 illustrate the hollow interior 46 of the club head 42 of the present invention. The interior hosel 54 is disposed within the hollow interior 46, and is located as a component of the face member 60. The interior hosel 54 may be composed of a similar material to the face member 60, and is secured to the face member 60 through welding or the like.; The interior hosel 54 is located in the face member 60 to concentrate the weight of the interior hosel 54 toward the face plate 72, near the heel section 66 in order to contribute to the ball striking mass of the face plate 72. A hollow interior 1 1 8 of the interior hosel 54 is defined by a hosel wall 1 20 that forms a cylindrical tube between the bore 114 and the aperture 59. In a preferred embodiment, the hosel wall 120 does not engage the heel wall 80 thereby leaving a void 115 between the hosel wall 1 20 and the heel wall 80. The shaft 48 is disposed within the interior hosel 54. Further, the hosel 54 is located inward, or rearward, from the striking plate 72 in order to allow for compliance of the striking plate 72 during impact with a golf ball. In one embodiment, the interior hosel 54 is disposed 0.125 inch rearward from the striking plate 72.

Figure 9:
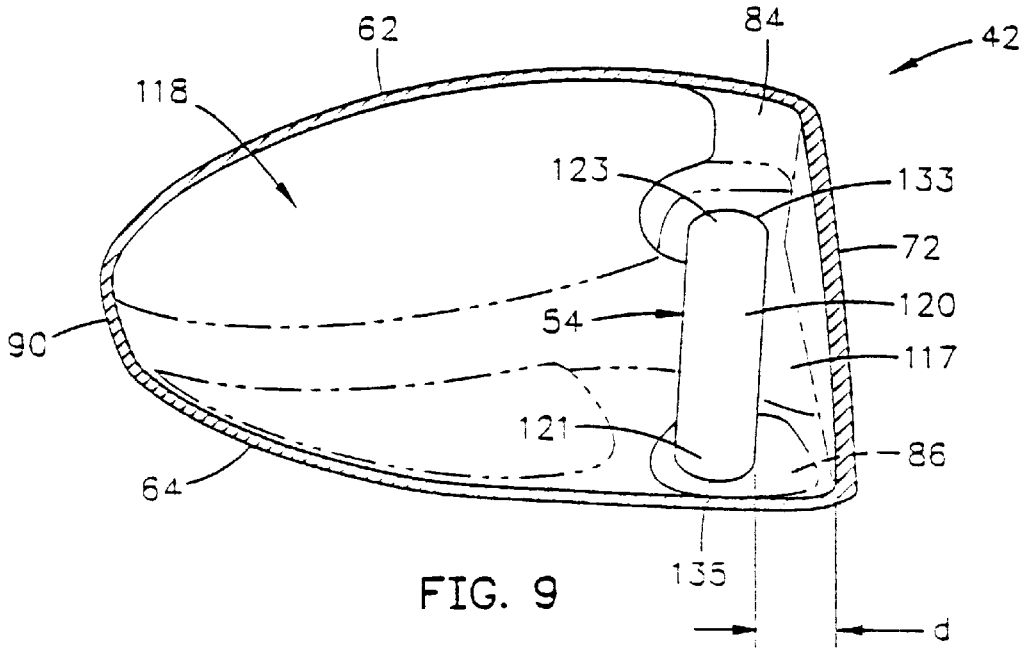
FIG. 9 is a cross-sectional view along line 9—9 of FIG. 1.

FIG. 9 is a cross-sectional view along line 9—9 of FIG. 1, illustrating the interior heel half of the golf club head 42. As shown in FIG. 9, the interior hosel 54 is off set inward in the hollow interior 11 8 from: the striking plate 72 to allow for compliance of the striking plate during impact with a golf ball. At a bottom end 121 of the interior hosel 54, the distance d between the hosel wall 120 and the striking plate 72 preferably ranges from 0.05 inch to 0.5, and is most preferably 0.25 inch. At the top end 123 of the interior hosel 54, the distance between the hosel wall 120 and the striking plate 72 may narrow, however, it remains unattached to the striking plate 72. Thus, there is always a void 117 between the hosel wall 120 and the striking plate 72.

Preferably, the interior hosel 54 is welded at an engagement 133 with the hosel section 84, and welded at an engagement 1 35 with the bore section 86.

Figure 11:
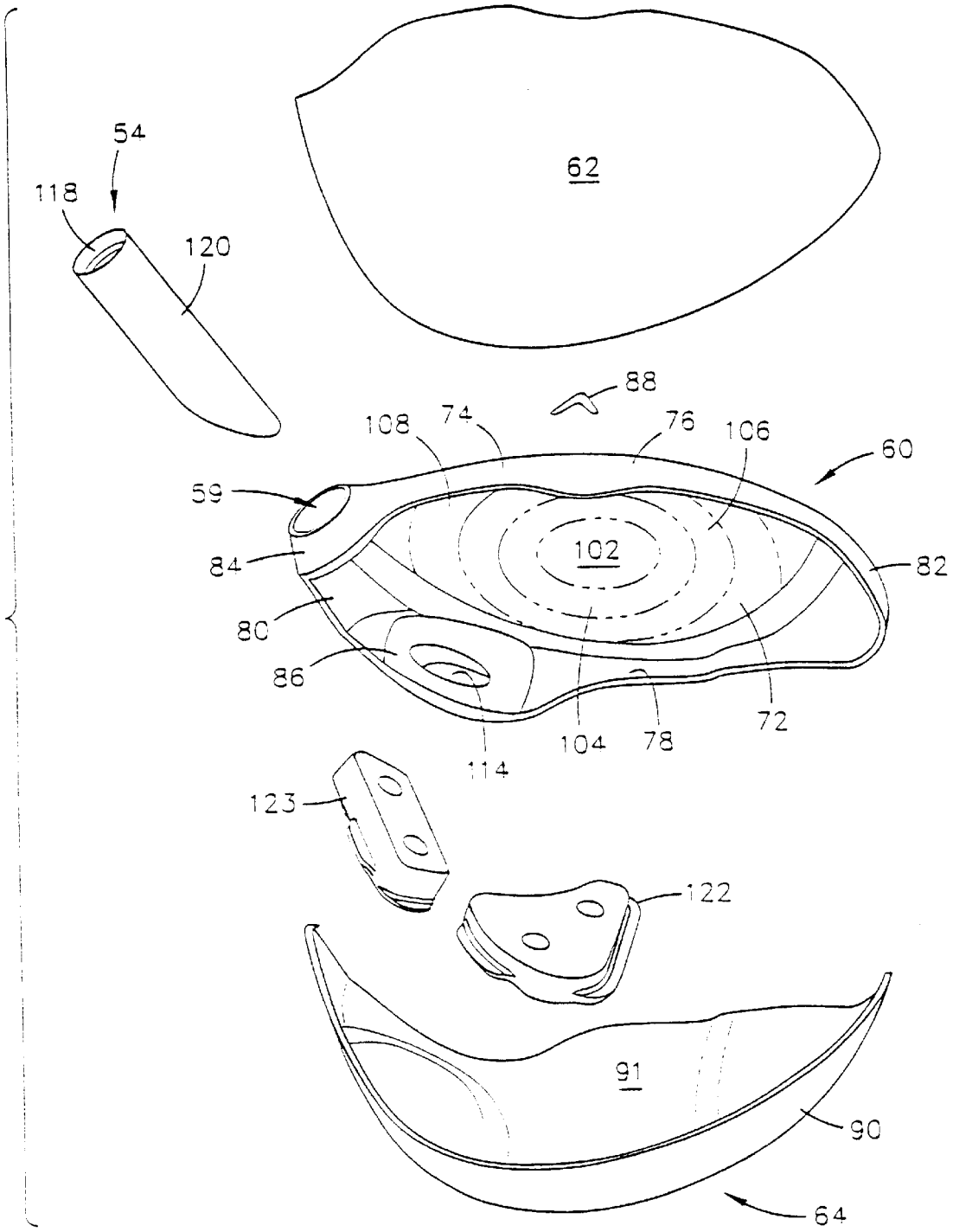
FIG. 11 is an exploded view of the component of the golf club head of the present invention.

Optional dual weighting members 122 and 123, as shown in FIG. 11, may also be disposed within the hollow interior 46 of the club head 42. In a preferred embodiment, the weighting members 122 and 123 are disposed on the sole 64 in order to the lower the center of gravity of the golf club 40. The weighting members 122 and 1 23, not shown, may have a shape configured to the contour of the sole 64. However, those skilled in the pertinent art will recognize that the weighting member may be placed in other locations of the club head 42 in order to influence the center of gravity, moment of inertia, or other inherent properties of the golf club 40. The weighting members 1 22 and 1 23 are preferably a pressed and sintered powder metal material such as a powder titanium material. Alternatively, the weighting members 122 and 123 may be cast or machined titanium chips. Yet further, the weighting members 1 22 and 123 may be a tungsten screw threadingly engaging an aperture 124 of the sole 64. Although titanium and tungsten have been used as exemplary materials, those skilled in the pertinent art will recognize that other high density materials may be utilized as an optional weighting member without departing from the scope and spirit of the present invention.

Figure 10:
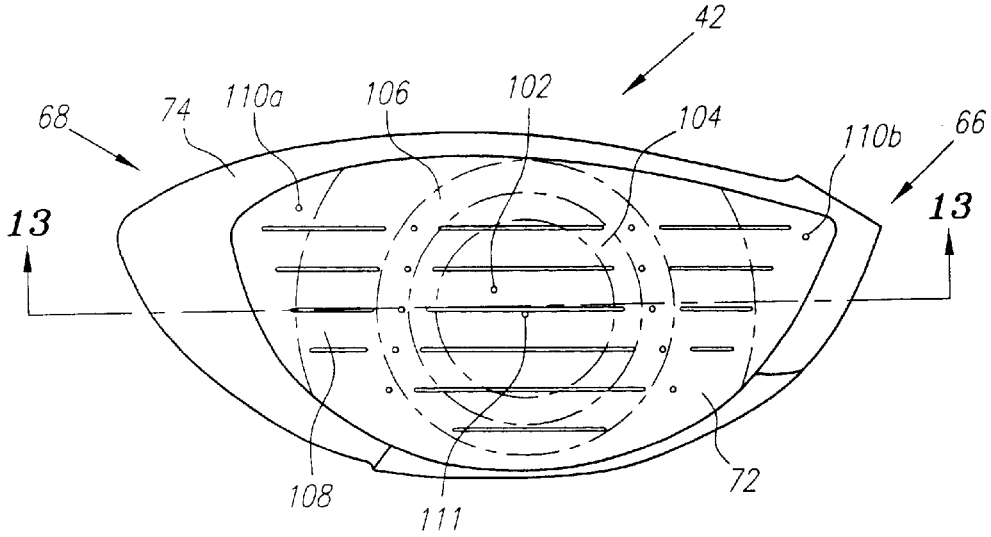
FIG. 10 is a front view of the golf club head of the present invention illustrating the variations in thickness of the striking plate.

FIG. 10 illustrates the variation in the thickness of the striking plate 72. The face plate or striking plate 72 is partitioned into elliptical regions, each having a different thickness. A central elliptical region 102 preferably has the greatest thickness that ranges from 0.110 inch to 0.090 inch, preferably from 0.103 inch to 0.093 inch, and is most preferably 0.095 inch. A first concentric region 104 preferably has the next greatest thickness that ranges from 0.097 inch to 0.082 inch, preferably from 0.090 inch to 0.082 inch, and is most preferably 0.086 inch. A second concentric region 106 preferably has the next greatest thickness that ranges from 0.094 inches: to 0.070 inch, preferably from 0.078 inch to 0.070 inch, and is most preferably 0.074 inch. A third concentric region 108 preferably has the next greatest thickness that ranges from 0.090 inch to 0.07 inch. A periphery region 110 preferably has the next greatest thickness that ranges from 0.069 inch to 0.061 inch. The periphery region includes toe periphery region 110*a* and heel periphery region 110*b*. The variation in the thickness of the striking plate 72 allows for the greatest thickness to be distributed in the center 111 of the striking plate 72 thereby enhancing the flexibility of the striking plate 72 which corresponds to a greater coefficient of restitution.

In an alternative embodiment, the striking plate 72 is composed of a vitreous metal such as iron-boron, nickel-copper, nickel-zirconium, nickel-phosphorous, and the like. These vitreous metals allow for the striking plate 72 to have a thickness as thin as 0.055 inch. Preferably, the thinnest portions of such a vitreous metal striking plate would be in the periphery regions 110*a* and 110*b*, although the entire striking plate 72 of such a vitreous metal striking plate 72 could have a uniform thickness of 0.055 inch.

Yet in further alternative embodiments, the striking plate 72 is composed of ceramics, composites or other metals. Further, the face plate or striking plate 72 may be an insert for a club head such as wood or iron. Additionally, the thinnest regions of the striking plate 72 may be as low as 0.010 inch allowing for greater compliance and thus a higher coefficient of restitution.

Figure 1A:
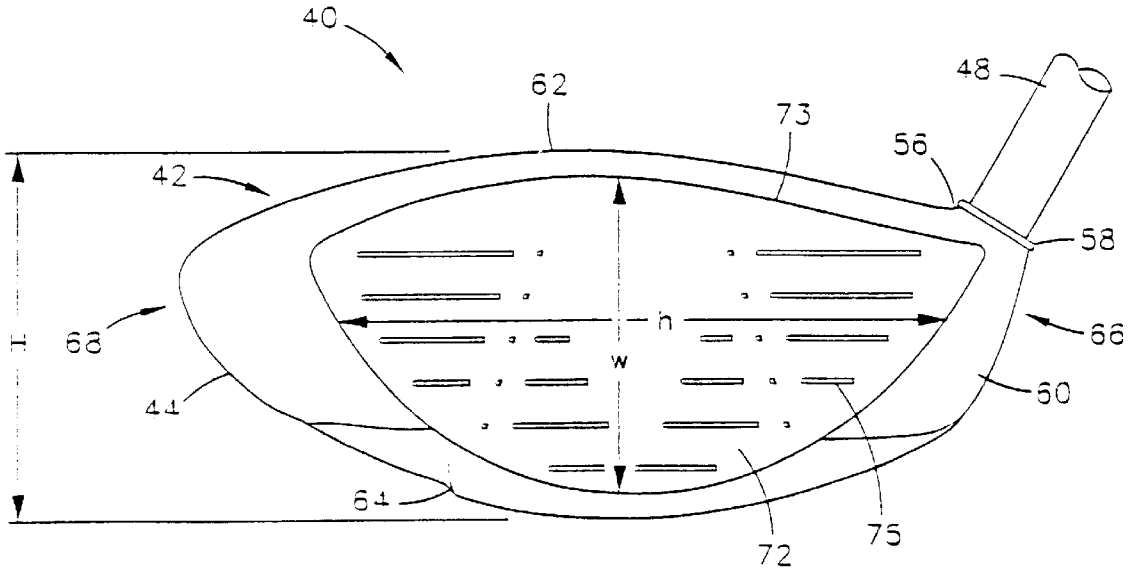
FIG. 1A is a front view of an alternative embodiment of the golf club of the present invention.

Additionally, the striking plate 72 of the present invention has a smaller aspect ratio than face plates of the prior art. The aspect ratio as used herein is defined as the width, w, of the face divided by the height, h, of the face, as shown in FIG. 1A. In one embodiment, the width w is 78 millimeters and the height h is 48 millimeters giving an aspect ratio of 1.635. In conventional golf club heads, the aspect ratio is usually much greater than 1. For example, the original GREAT BIG BERTHA® driver had an aspect ratio of 1.9. The face of the present invention has an aspect ratio that is no greater than 1.7. The aspect ratio of the present invention preferably ranges from 1.0 to 1.7. One embodiment has an aspect ratio of 1.3. The face of the present invention is more circular than faces of the prior art. The face area of the striking plate 72 of the present invention ranges 4.00 square inches to 7.50 square inches, more preferably from 4.95 square inches to 5.1 square inches, and most preferably from 4.99 square inches to 5.06 square inches.

The club head 42 of the present invention also has a greater volume than a club head of the prior art while maintaining a weight that is substantially equivalent to that of the prior art. The volume of the club head 42 of the present invention ranges from 175 cubic centimeters to 400 cubic centimeters, and more preferably ranges from 300 cubic centimeters to 310 cubic centimeters. The weight of the club head 42 of the present invention ranges from 165 grams to 300 grams, preferably ranges from 175 grams to 225 grams, and most preferably from 188 grams to 195 grams. The depth of the club head from the striking plate 72 to the rear section of the crown 62 preferably ranges from 3.606 inches to 3.741 inches. The height, H, of the club head 42, as measured while in striking position, preferably ranges from 2.22 inches to 2.27 inches, and is most preferably 2.24 inches. The width, W, of the club head 42 from the toe section 68 to the heel section 66 preferably ranges from 4.5 inches to 4.6 inches.

Figure 12:
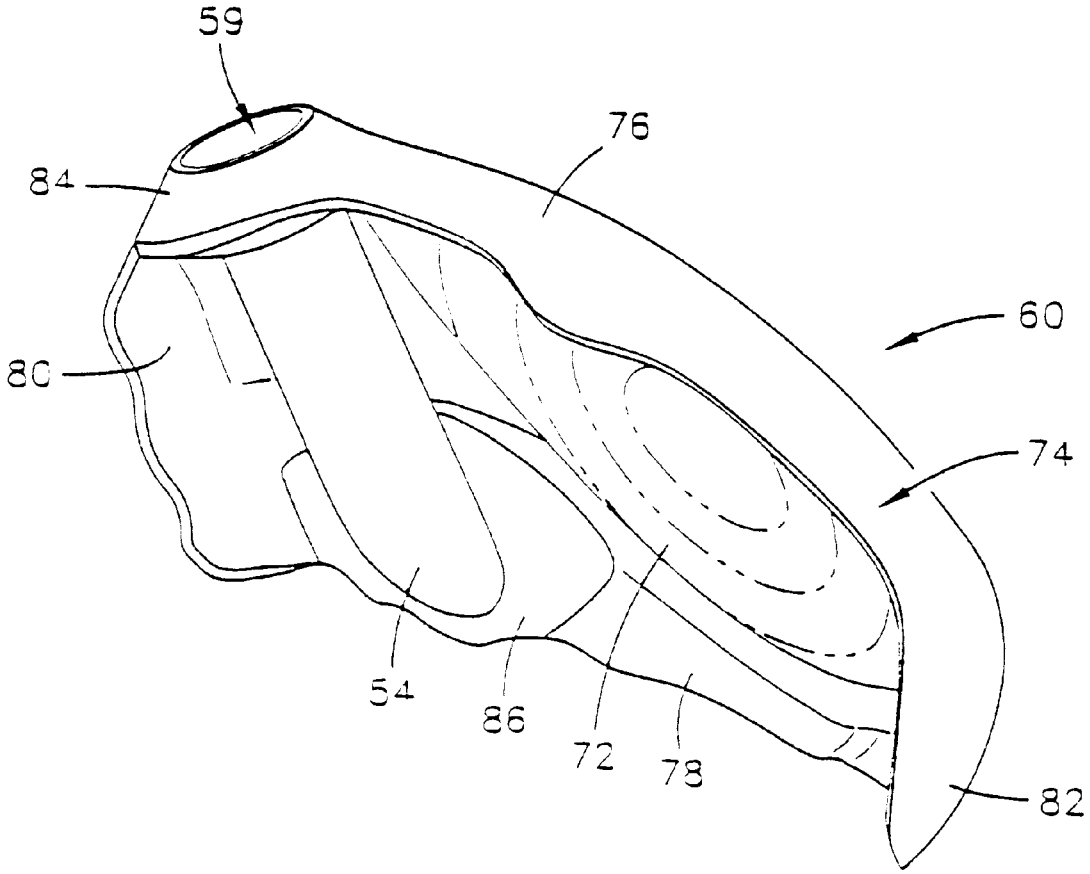
FIG. 12 is an isolated view of the face member with the interior hosel attached.
Figure 13:
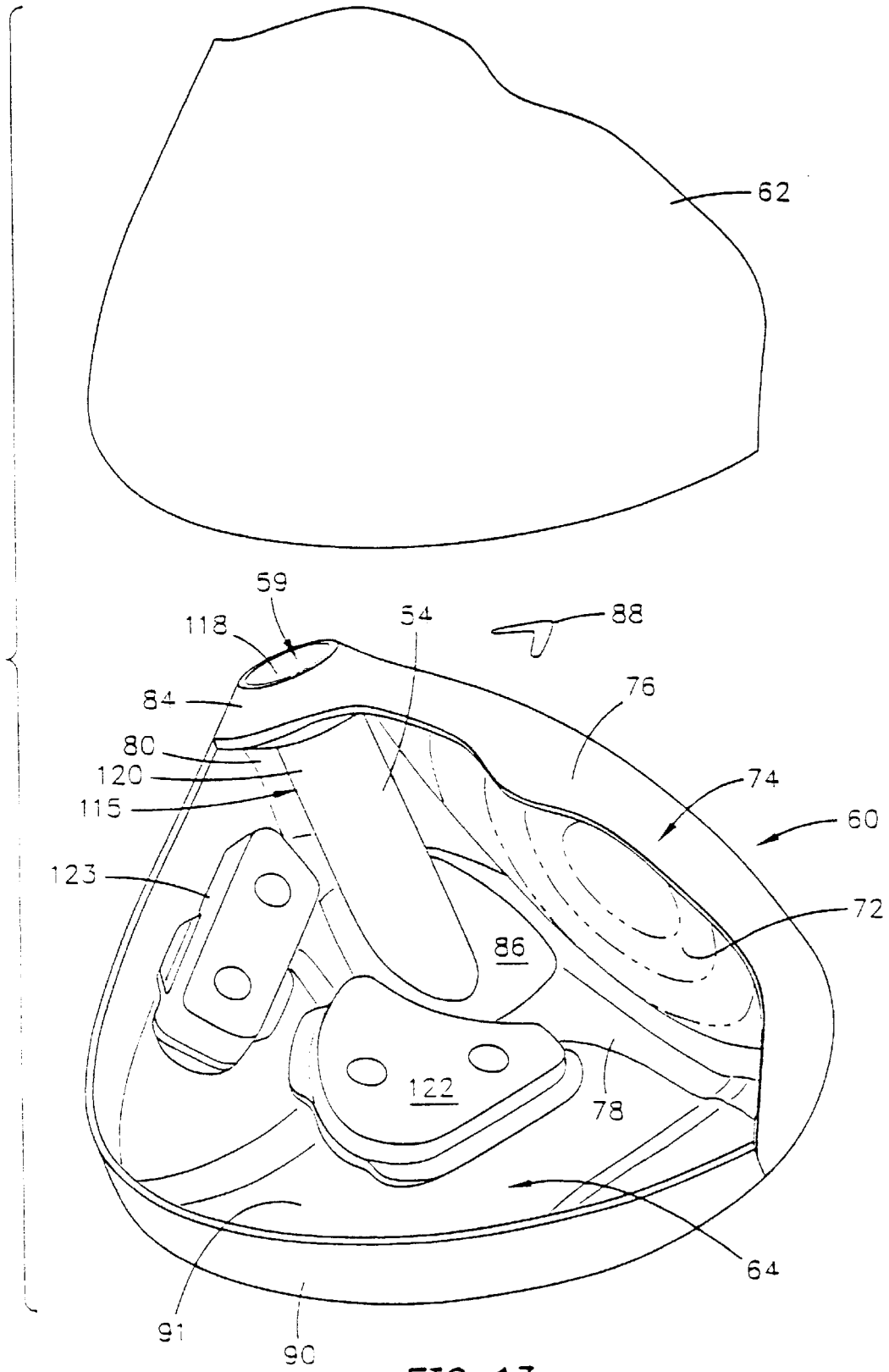
FIG. 13 is an exploded view of the crown and the connected sole and face member.

FIGS. 11–13 illustrate a preferred assembly of the different components of the golf club head 42. Essentially there are four main components, the face member 60, the crown 62, the sole 64 and the interior hosel 54. Sub-components include the weight members 122 and 123 and the decal 88. Preferably, the face member 60 is formed in a forging process to create the striking plate 72 and face extension 74 with the upper lateral extension 76, the lower lateral extension 78, the heel wall 80 and the toe wall 82. The aperture 59 is drilled in the hosel section 84 of the upper lateral extension 76, and the drilling continues downward to the bore section 86 where the bore 114 is created in the bore section 86. The bore section 86 preferably has a greater thickness than the hosel section 84 due to manufacturing needs such as welding and shaft assembly.

Next, as shown in FIG. 12, the interior hosel 54 is welded to the hosel section 84 and the bore section 86 in alignment with the aperture 59 and the bore 114. In a preferred embodiment, a solid cylinder is welded to the hosel section 84 and the bore section 86 in alignment with the aperture 59 and the bore 114, and then the solid cylinder is reamed to create the hollow interior 118 of the interior hosel 54, as defined by the hosel wall 120. In an alternative embodiment, the interior hosel may be pre-reamed prior to welding to the face member 60. Those skilled in the pertinent art will recognize that methods similar to welding may be employed for attachment of the hosel 54 to the face member 60 without departing from the scope and spirit of the present invention.

Next, the sole 64 is welded to the face member 60 (with attached hosel 54) as shown in FIG. 13. The weight members 122 and 1 23 are attached on the bottom section 91 of the sole 64, and then the crown 62 is welded to the face member 60 and the ribbon section 90 of the sole 64.

Figure 14:
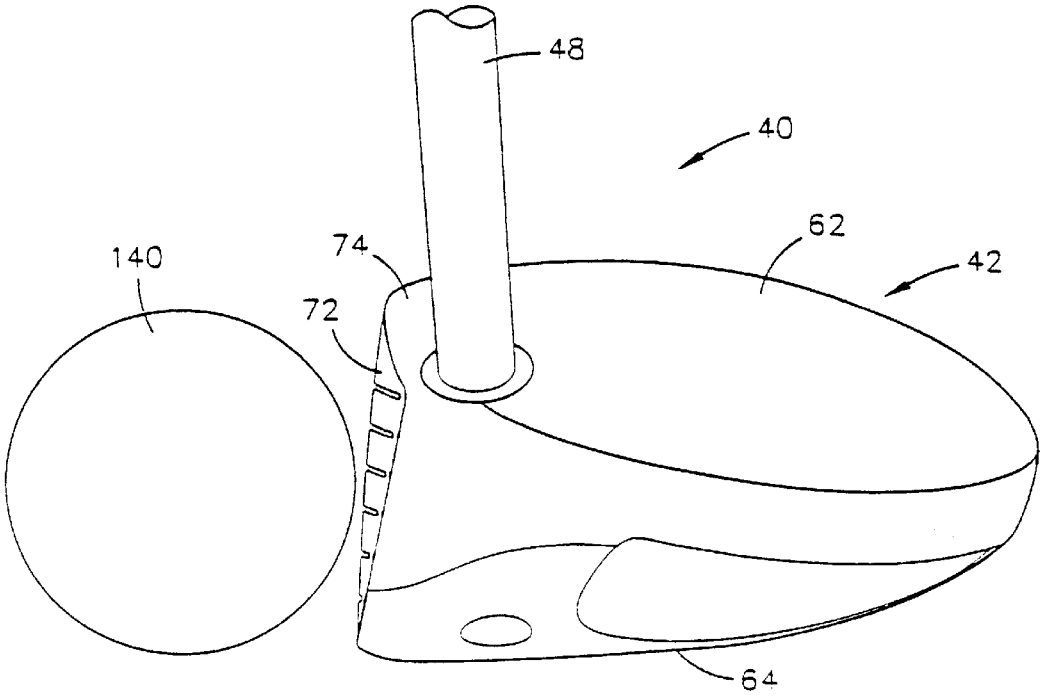
FIG. 14 is a side view of a golf club head of the present invention immediately prior to impact with a golf ball.
Figure 15:
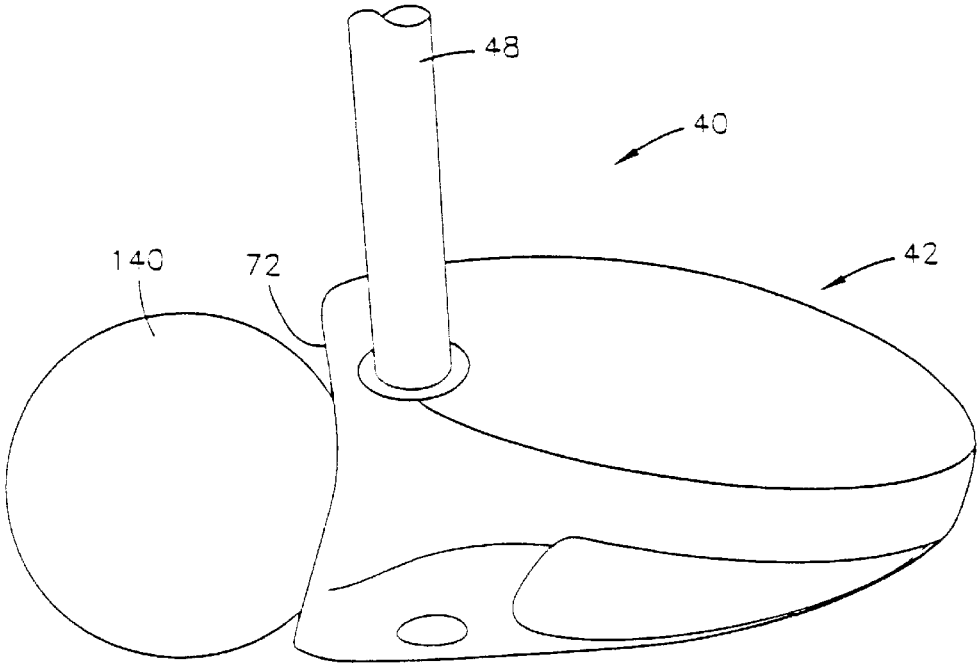
FIG. 15 is a side view of a golf club head of the present invention during impact with a golf ball.
Figure 16:
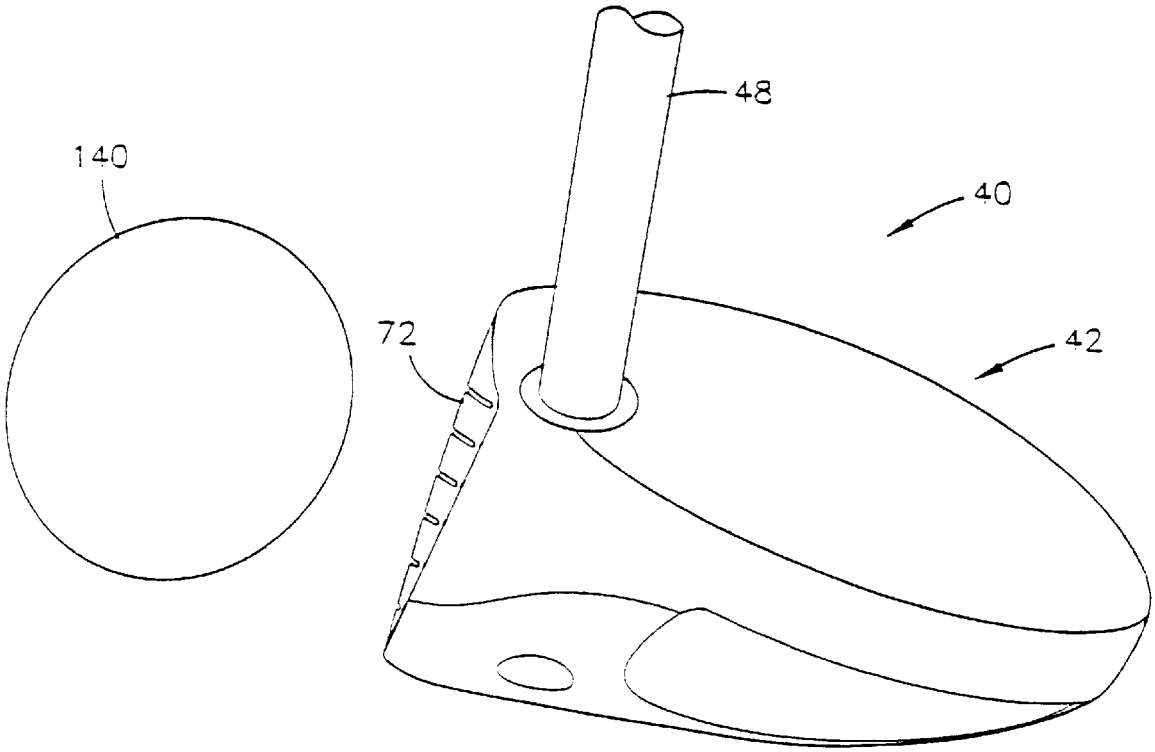
FIG. 16 is a side view of a golf club head of the present invention immediately after impact with a golf ball.

As shown in FIGS. 14–16, the compliance of the striking plate 72 allows for a greater coefficient of restitution, in the range of 0.83 to 0.93 under test conditions such as the USGA test conditions specified pursuant to Rule 4-1 e, Appendix II of the Rules of Golf for 1998 –1999. At FIG. 14, the striking plate 72 is immediately prior to striking a golf ball 140. At FIG. 15, the striking plate 72 is engaging the golf ball, and deformation of the golf ball 140 and striking plate 72 is illustrated. At FIG. 16, the golf ball 140 has just been launched from the striking plate 72. Thus, unlike a spring, the present invention increases compliance of the striking plate to reduce energy losses to the golf ball at impact, while not adding energy to the system.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for producing a golf club head with an internal hosel, the method comprising:

providing a face member having a striking plate with an interior surface and a face extension extending laterally inward from the interior surface of the striking plate, the face extension having an upper portion, a lower portion and a heel wall;

drilling a hole through the upper portion of the face extension in proximity to the heel wall;

placing a cylinder in alignment with the hole in the upper portion; and attaching the cylinder to the upper portion and the lower portion of the face extension, the cylinder disposed inward from the striking plate.

2. The method according to claim 1 further comprising reaming the cylinder to create a hole in the cylinder prior to inserting the cylinder through the hole in the upper portion.

3. The method according to claim 1 further comprising reaming the cylinder to create a hole in the cylinder subsequent to inserting the cylinder through the hole in the upper portion.

4. The method according to claim 1 wherein attaching the cylinder comprises welding the cylinder to the upper portion and the lower portion of the face extension.

5. The method according to claim 1 further comprising drilling a hole through the lower portion of the face extension, and aligning the cylinder with the hole in the lower portion of the face extension.

6. The method according to claim 1 wherein the striking plate is composed of a forged titanium material.

7. The method according to claim 1 wherein the cylinder is disposed at least 0.20 inch from the striking plate at its attachment to the lower portion.

8. The method according to claim, 1 further comprising attaching a sole plate and a crown to the face member.

9. The method according to claim 1 wherein the cylinder has an angled bottom end for attachment to the lower portion of the face extension.

10. A method for producing a golf club head with an internal hosel, the method comprising:

providing a face member having a striking plate with an interior surface and a face extension extending laterally inward from the interior surface of the striking plate, the face extension having an upper portion, a lower portion and a heel wall, the face member composed of a forged titanium material;

drilling a hole through the upper portion and a hole through the lower portion of the face extension in proximity to the heel wall;

inserting a solid cylinder through the hole in the upper portion and in alignment with the hole in the lower portion;

welding the solid cylinder to the upper portion and the lower portion of the face extension, the cylinder disposed inward from the striking plate to allow for compliance of the striking plate during impact with a golf ball; and reaming a hole through the solid cylinder to form the interior hosel for receiving a shaft therethrough.

* * * * *